US007267504B2

(12) United States Patent
Brooks

(10) Patent No.: US 7,267,504 B2
(45) Date of Patent: Sep. 11, 2007

(54) SELF-SUPPORTING WRITING INSTRUMENT

(75) Inventor: Matthew L. Brooks, Kansas City, MO (US)

(73) Assignee: Jeffrey S. Brooks, Inc., St. Louis, MO (US)

( * ) Notice: Subject to any disclaimer, the term of this patent is extended or adjusted under 35 U.S.C. 154(b) by 291 days.

(21) Appl. No.: 10/860,246

(22) Filed: Jun. 3, 2004

(65) Prior Publication Data

US 2005/0271455 A1 Dec. 8, 2005

(51) Int. Cl.
*B43K 23/02* (2006.01)
*B43K 29/00* (2006.01)

(52) U.S. Cl. ..... 401/131; 401/195

(58) Field of Classification Search ..... 401/48, 401/52, 131, 195; 24/11 CC, 11 C, 111 F, 24/11 M See application file for complete search history.

(56) References Cited

U.S. PATENT DOCUMENTS

| | | | | | |
|---|---|---|---|---|---|
| 454,064 | A | * | 6/1891 | Pfeiffer | 401/131 |
| 575,458 | A | | 1/1897 | Canfield | |
| 1,818,081 | A | * | 8/1931 | Mingos | 401/48 |
| 1,840,191 | A | * | 1/1932 | Eubanks | 401/6 |
| 2,568,907 | A | * | 9/1951 | Bernstein | 248/351 |
| 3,425,779 | A | | 2/1969 | Fisher et al. | |
| 3,972,628 | A | | 8/1976 | Stevers | |
| 4,149,812 | A | | 4/1979 | Huffman, Jr. | |
| 4,865,285 | A | | 9/1989 | Gaggoamese | |
| D305,777 | S | * | 1/1990 | Lee | D19/85 |
| 4,917,517 | A | * | 4/1990 | Ertz | 401/6 |
| 4,944,624 | A | | 7/1990 | Garland | |
| D316,274 | S | * | 4/1991 | Suzuki | D19/85 |
| 5,033,629 | A | | 7/1991 | Caine | |
| 5,037,224 | A | | 8/1991 | Wright | |
| 5,454,654 | A | | 10/1995 | Bergstrom | |
| 5,651,626 | A | | 7/1997 | Chen | |
| 5,823,494 | A | * | 10/1998 | Jones et al. | 248/309.1 |
| 5,839,712 | A | | 11/1998 | Wang | |
| 5,915,807 | A | | 6/1999 | Ilagan | |
| 6,471,432 | B1 | | 10/2002 | Kremer | |
| 6,592,279 | B1 | | 7/2003 | Kagel | |

* cited by examiner

*Primary Examiner*—David J. Walczak
(74) *Attorney, Agent, or Firm*—Senniger Powers

(57) ABSTRACT

A writing instrument having a shaft, a writing tip, a coating-liquid reservoir and a support that operably cooperate with each other. The writing tip located at one end of the shaft and the support located near an opposite distal end. The support preferably includes a plurality of legs that extend outwardly from the shaft in a use configuration so that when the instrument is in a resting position on a horizontal surface, the legs contact the surface and prop the distal end of the writing instrument upward while the writing tip contacts the surface allowing the writing instrument to be more easily grasped by a user and so as to naturally bias the contents of the liquid reservoir toward the writing tip via gravity, thus allowing the writing instrument to be readily useable.

13 Claims, 4 Drawing Sheets

SELF-SUPPORTING WRITING INSTRUMENT

BACKGROUND OF THE INVENTION

The present invention is directed to a self-supporting writing instrument having a raised resting or stored position for use in various applications utilizing the distribution of a substance such as ink and the like onto a substrate and especially to such a writing instrument adapted to be used during various coating applications having a fluid reservoir with a writing or marking end at one end and self-supporting legs near the other end that extend or pivot from the stored position to a use position for the purpose of holding and stabilizing the instrument on a horizontal surface and positioning the instrument in an angled-upward direction to allow for ease of grasp by a user and to extend an end of the reservoir opposite the writing end above the writing end in order to provide a natural bias of writing fluid toward the writing end of the instrument via gravity.

Traditional writing instruments, such as pens and other devices with fluid reservoirs, operate by utilizing a writing fluid, such as ink, that is contained within such a reservoir. The reservoir communicates with the writing end so that, during operation, the writing end discharges the ink onto a substrate. These traditional pens are very popular, but tend to suffer from an inherent limitation. Generally, for proper usage and discharge of the ink onto a substrate or writing surface such as paper, the reservoir must be positioned above the writing end so that the ink is urged by gravity into constant flow-contact with the writing end to prevent a tip on the writing end from becoming dry. Often, the pen has to be shaken initially or held in a vertical alignment for awhile to get the flow of ink started and sometimes the pen has to be shaken again and again as use continues. This is true when the reservoir is positioned below or at the same level as to the writing end and particularly when the reservoir is becoming depleted.

Another disadvantage of traditional pens is that many do not have pen stands, which is especially likely if the pen is disposable. Pen stands are used to support the pen on a horizontal surface, such as a desk, and are typically purchased with relatively expensive writing instruments for positioning and securing the pen in a fixed location and within easy grasp of a user. Some users desire a pen that does not roll across the table and can be secured allowing the user to easily reach for and grasp the pen. Pen stands are especially convenient for users that are handicapped or are required to wear surgical gloves or the like with both user-types having impaired dexterity preventing easy manipulation (e.g. picking up) of the pen in its traditional horizontal resting position.

Therefore, it is desirable to provide a writing instrument designed to provide a constant flow of writing fluid to the writing end, to provide such a writing instrument that can be positioned and secured on a horizontal surface with a support that prevents the instrument from rolling off the surface and to provide such a writing instrument that is self-supporting and is angled upward from the tip and facilitates easy grasp by a user.

SUMMARY OF THE INVENTION

The present invention is directed to a self-supporting coating or writing instrument that comprises a shaft, a writing end, a writing fluid reservoir and a support for the shaft. The writing instrument or pen is attached to the support in a manner such that when the pen and support are placed on a table between uses, the end of the reservoir opposite a writing tip or end thereof is situated above the writing end, ensuring a constant flow of writing fluid via gravity to the writing end even when the pen is resting on a horizontal surface.

In some embodiments, the support is fixed in position relative to the writing instrument, but in certain embodiments, the support is in the form of a leg having one end hinged to a dorsal and near a rearward end of the pen with an opposite end of the support capable of pivoting away from the pen in order to alternate from a stored configuration to a use configuration. In the use configuration, the support leg extends or pivots away from the shaft to a preselected angle such as ninety degrees in order to form a support structure, especially a tripod configuration with the writing end. The use configuration allows the pen to be placed on a horizontal surface while the dorsal end is propped upward within easy grasp of the user and the reservoir is extended upwardly above the writing end, thus utilizing gravity to bias the fluid contents of the reservoir toward the writing end of the instrument to provide an instrument that is readily graspable and useable. In such an embodiment, when the writing instrument is in the stored position, the leg pivots to extend alongside and generally parallel to the reservoir and shaft in a low profile alignment. In either configuration, the support is designed to be locked or frictionally secured in a selected angular configuration with respect to the shaft. In each case, the selected position can be modified by simple manual manipulation.

Further in accordance with the present invention, the support in the use configuration secures and stabilizes the instrument on a horizontal surface acting as a pen stand, thus positioning the instrument in an angled-upward direction from the tip to allow for ease of grasp by a user and to extend the reservoir above the writing end in order to provide a natural bias of liquid toward the writing end of the instrument via gravity.

An additional feature of the self-contained pen stand is that unlike traditional fixed location pen stands that establish a home for the pen requiring the pen to return to the same place after every use, the present invention allows the pen to be placed upon a horizontal or near-horizontal surface irrespective of where the pen was stored immediately prior to the current use. In other words, the pen stand of the invention is integrated with and travels with the pen allowing the user to stand the pen wherever the user chooses to place the pen, thus providing a highly adaptable pen for use in various situations.

OBJECTS AND ADVANTAGES OF THE INVENTION

Therefore, the objects in the present invention are: to provide a self-supporting coating or writing instrument that comprises a shaft, a writing end, a writing fluid reservoir and a support that operably cooperate with each other to support an upper end of the writing instrument above the writing end thereof; to provide such a writing instrument having a support with at least one leg provided to prop the instrument upward; to provide such a writing instrument wherein the support has an extendable leg that can be operably extended away from the instrument by manual or mechanical manipulation into a use configuration or folded toward the instrument into a low profile storage configuration; to provide such a writing instrument with a support that is comparatively low profile and which is comparatively light in weight; to provide such a writing instrument with a support that is capable of use with and adaptable to multiple different types of writing instruments; to provide such a writing instrument with a support that is locked, especially by frictional engagement, in position relative to the instrument in both the use configuration and where appropriate, the storage configuration; to provide such a writing instrument with a support that is ergonomic and has as little detrimental effect on the user as possible; to provide such a writing instrument with a support that is integrated with a relatively small profile both in height and width; to provide such a writing instrument that is a self-supporting writing instrument that is lightweight, low profile, easy to use and which is configured in such a manner that in both the use configuration and the storage configuration, when appropriate, the writing instrument is ergonomic so that the additional feature of the support is non-intrusive; to provide such a writing instrument with a support that is inexpensive to provide, easy to use, effective for the intended usage thereof and especially adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 3:
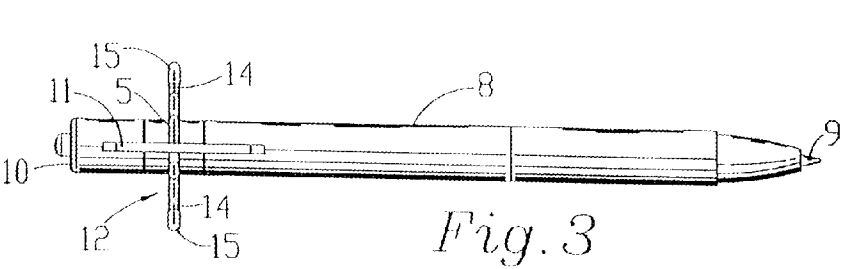
FIG. 3 is a top-plan view illustrating the writing instrument.
Figure 1:
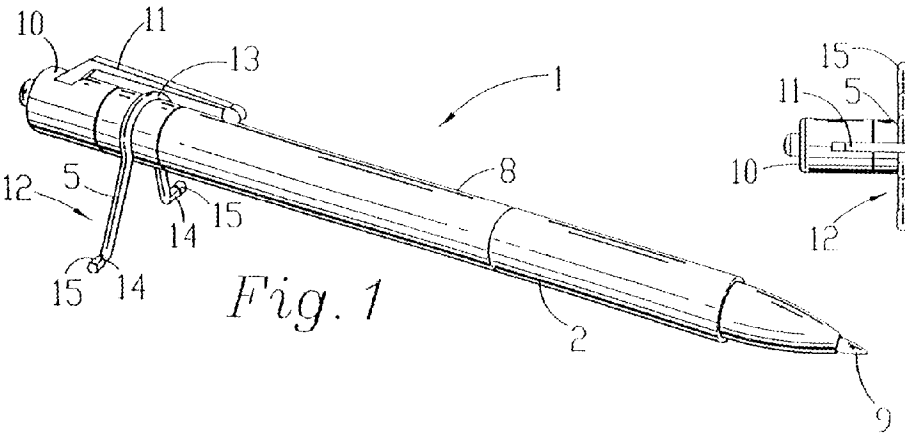
FIG. 1 is a perspective view illustrating a writing instrument with a support in accordance with the present invention.
Figure 2:
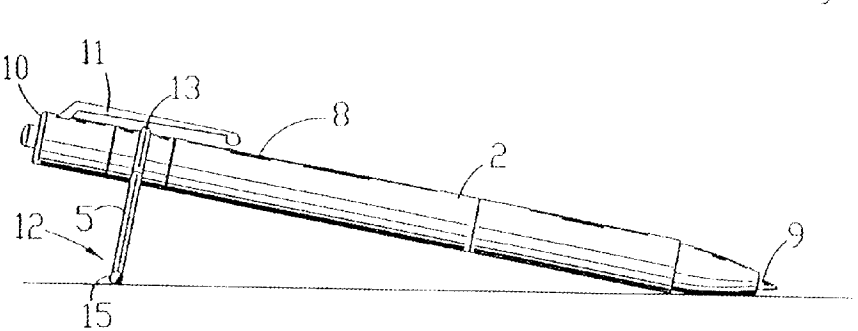
FIG. 2 is a side-elevational view illustrating the writing instrument.
Figure 4:
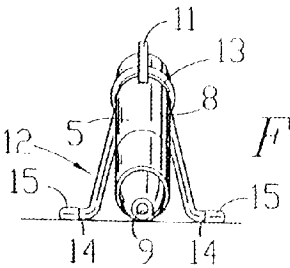
FIG. 4 is a front-elevational view illustrating the writing instrument.
Figure 5:
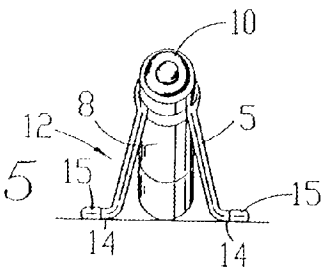
FIG. 5 is a rear-elevational view illustrating the writing instrument.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference number 1 generally represents a self-supporting coating or writing instrument in accordance with the present invention and as depicted in FIGS. 1-5. The writing instrument 1 primarily consists of an elongated body 2 and a detachable support 5 that are assembled after manufacture allowing for the detachable support 5 to be used with a number of different shaped bodies. The detachable support 5 engages the body 2 at one end of a shaft 8 opposite a writing end 9 near a distal or rear end 10. The support 5 can be used in combination with a traditional pen clip 11, as shown and which are well-known in the art, so as to not detract from the operation and use of the clip 11.

In the preferred embodiment, the support 5 is constructed of an elongated wire, but it is foreseen that another like material such as plastic can be utilized providing that the material properties include sufficient resiliency and memory to be able to flex and spring around a shaft of a coating instrument and snap back and return to its original configuration at a central C-shaped region sized and shaped to snugly surround the shaft.

The detachable support has legs 12 extending outward from the C-shaped region 13. The legs 12 are spaced in relationship with one another and diverge outwardly away from the body 2 to provide a triangular support system to the writing instrument 1. The C-shaped region 13 is designed to receive various shafts having a common or conventional width that are found among writing instruments 1, which is approximately ⅜ inches diameter. The C-shaped region 13 is designed to engage the shaft 8 by flexing outward and then snapping around the shaft 8.

Figure 12A:
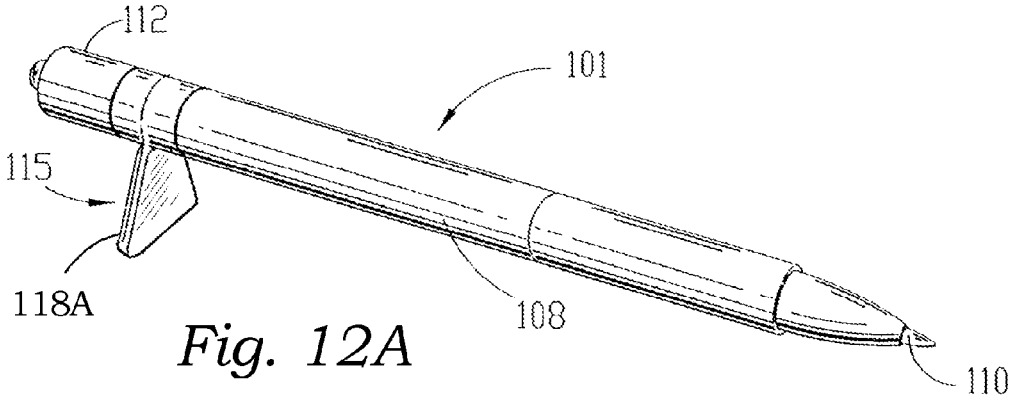
FIG. 12A is a perspective view of another example of the second embodiment of the writing instrument.

It is foreseen that a support could utilize a number of designs such as a single relatively wide leg or a single leg with a relatively wide base having a V shape (FIG. 12A) or U shape. Also foreseen is a support that is connected to a writing instrument cap, which can be selectively placed on either end of a writing instrument shaft having a support that provides sufficient stability for the intended supporting function of the present invention.

At the lower or distal end of each leg 12 is an outwardly extending foot 14. Located on ends of each foot 14 are rubber or plastic balls or pads 15 to provide friction on a non-slip surface upon engagement with a horizontal surface or something of the like and to prevent the support 5 from scratching the horizontal surface. While it is foreseen that a number of other materials could be utilized to form the pads 15, the pads 15 are ideally manufactured by dipping the tips of the legs 12 into liquid polyurethane.

The writing instrument 1 is especially advantageous for use in applications requiring a plethora of different liquids of various colors, viscosities and textures, along with different marking tips, etc., which require a user to sporadically switch back and forth between the liquids and tips during operation. While archaic instruments, which are designed to be laid flat on a table or the like, would require the user to shake the instrument to bias the liquid toward the marking end of the instrument when use is desired, the present invention provides the user with writing instruments 1 that are readily useable. Furthermore, if the user is operating on a surface that is not horizontal, such as an architect's desk, the present invention provides the user with coating instruments that can be secured in one position, thus preventing undesired migration of the instrument across the surface.

In a second embodiment as depicted in FIGS. 6-12, a hinged, self-supporting writing instrument 101 has an elongated shaft 108 with a marking or writing tip or end 110 at one extremity of the shaft 108. Within the shaft 108 is a coating or liquid reservoir 109 that flow-communicates with the writing end 110.

Figures 6, 7, 8, 9, 10, 11, 12:
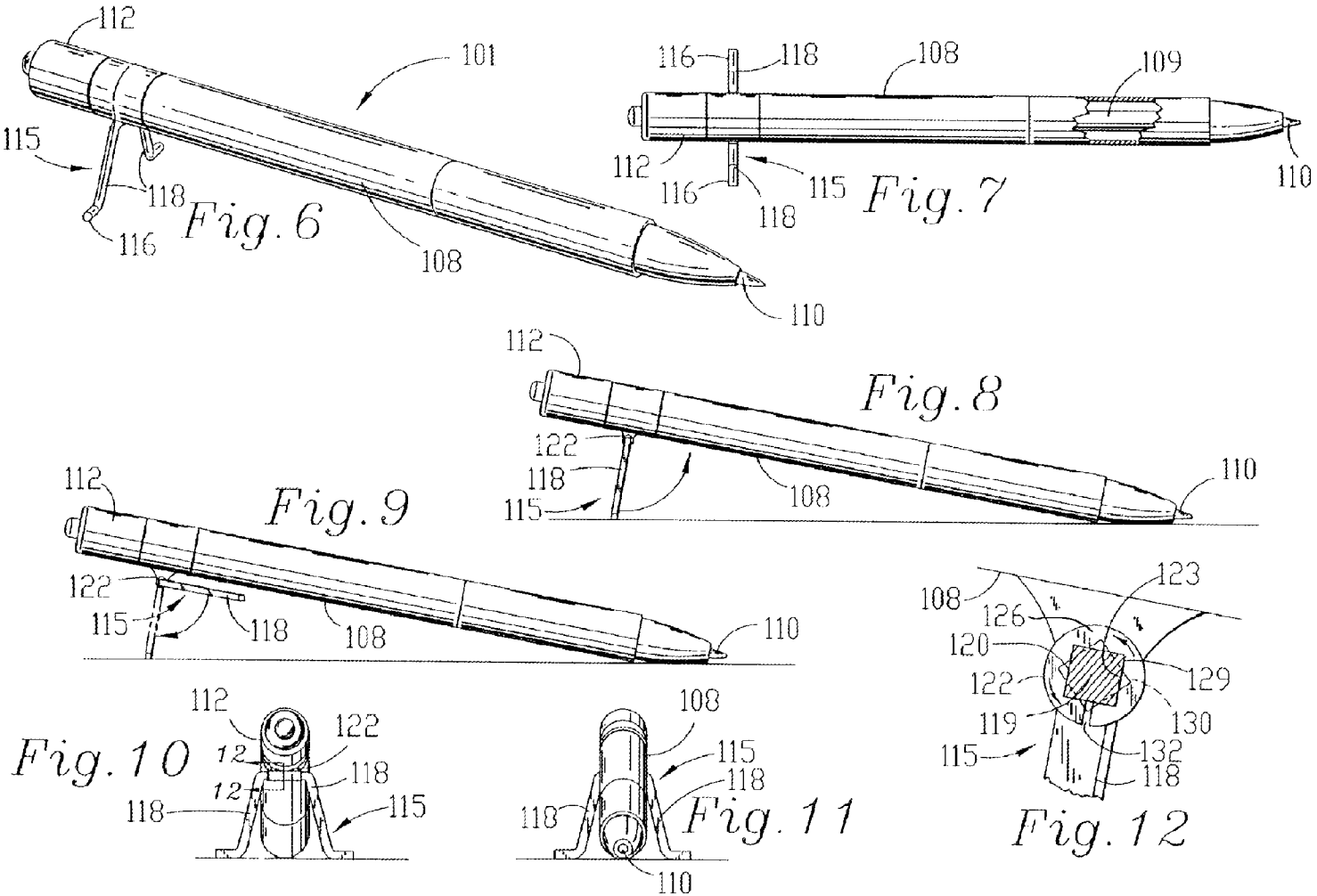
FIG. 6 is a perspective view illustrating a second embodiment of a writing instrument according to the present invention having a support shown in a use or supporting configuration.
FIG. 7 is a top-plan view illustrating the second embodiment of the writing instrument in the use configuration with a portion broken away to show a fluid reservoir.
FIG. 8 is a side-elevational view illustrating the second embodiment of the writing instrument in the use configuration.
FIG. 9 is a side-elevational view illustrating the second embodiment of the writing instrument in a stored configuration in solid lines and in the use configuration in phantom lines.
FIG. 10 is a rear-elevational view illustrating the second embodiment of the writing instrument in the use configuration.
FIG. 11 is a front-elevational view illustrating the second embodiment of the writing instrument in the use configuration.
FIG. 12 is an enlarged cross-sectional view, taken along 12-12 of FIG. 10, illustrating a hinge and keeper of the second embodiment of the writing instrument with the support in the use configuration.

Opposite the writing end 110 of the shaft 108 near a distal or rear end 112 is a support 115. In the present embodiment, the support 115 is integrated with or pivotally joined to the shaft 108 during manufacture of the writing instrument 101. The support 115 has legs 118 joined by a bar 119 having shaft-engagement surface 120. At the lower or distal end of each leg 118 is an outwardly extending foot 116. As depicted in FIG. 12, the bar 119 is square in cross section and is attached to the distal end 112 of the shaft 108 via a flexible keeper 122, having an interior surface 123 that is snugly mateable with the bar when in a relaxed configuration. The keeper 122 is flexible and can be biased to a stretched configuration by applying manual pressure rotational to the support 115. The keeper 122 includes a flex channel 132 to allow flexing of the keeper upon rotation of the bar 119. In this manner, the bar 119 rotates in the keeper 122 between a first stable position seen in FIG. 9 in solid lines wherein the support 115 is in a non-extended position and a second stable position seen in FIG. 9 in phantom lines wherein the support 115 is in an extended and supporting position. The keeper 122 springs or flexes outwardly under pressure to allow the support 115 to move between the position described, but returns to snugly cradle the support 115 in a desired position, once that position is obtained. In particular, the keeper 122 allows the legs 118 to pivot away from and alternatively toward the shaft 108 in order to alternate from a stored configuration to a use configuration. In the use configuration, the support legs 118 extend or pivot away from the shaft 108 to a preselected angle such as ninety degrees in order to form a tripod configuration with the coating end 110.

It is foreseen that the keeper 122 forming a hinge with the bar 119 could be constructed with a clip that goes around a shaft so that a leg or legs may pivot relative to the shaft. It is also foreseen that the keeper 122 forming a hinge, as depicted in FIG. 9, could be located on the opposite side of a shaft so that when converting from a storage to a use configuration, a leg or legs pivot toward and straddle the shaft as opposed to away from the shaft as depicted in FIG. 9. In either instance, the clip and/or legs would flex and spring around a shaft and snap back and return to its original configuration or may be more rigid and slide along the shaft from one end thereof into a desired locator. Where resistence is required, the support may be constructed of a material that is sufficiently resilient and has memory.

In the use configuration, as depicted in FIG. 8, the writing instrument 101 can be placed on a horizontal surface while the distal end 112 is propped upward within easy grasp of a user and an interior reservoir 109, located within the shaft 108 as depicted in FIG. 7, is extended upwardly above the writing end 110, thus utilizing gravity to bias the fluid contents of the reservoir 109 toward the marking end 110 of the instrument 101 to provide an instrument 101 that is readily graspable and useable. In the stored position, as depicted in solid lines in FIG. 9, the legs 118 pivot to extend alongside and generally parallel to the reservoir 109 and shaft 108 at a preselected angle, such as zero degrees. The present embodiment provides space between the shaft 108 and the legs 118 in order to allow the legs 118 to act as a traditional pen clip. However, it is foreseen that in some embodiments, that a support could be provided that is flush mounted to a shaft with the shaft having an outer surface that corresponds to the support with the support designed to fold outward.

In either configuration, the writing instrument 101 is designed to provide two stabilized positions at a selected angular configuration with respect to the shaft 108. While it is foreseen that stabilization can be achieved with a number of designs, the present embodiment utilizes a spring-loaded outward C-shaped member 126 with the interior surface 123 that engages the shaft-engagement surface 120 and is located within the keeper 122, as depicted in FIG. 12. The shaft-engagement surface 120 has a rectangular surface 129 that matingly engages and aligns with a corresponding mating surface 130 of the keeper interior surface 123. The surfaces 129 and 130 have sufficient resiliency so that the support surface 129 can rotate within the mating surface 130 with the application of force. Specifically, the application of pressure overcomes and biases out the keeper 122 allowing rotation of the shaft-engagement surface 120 and pivoting of the legs 118. The bar 119 is initially inserted in the keeper 122 by forcibly spreading opposites sides thereof at the flex channel 132 and urging the bar 119 therethrough.

Referring to FIG. 12 A, in another example of the second embodiment of the writing instrument 101, the support 115 comprises a single leg 118A with a relatively wide base having a V shape. The use and function of the single leg 118A is similar to the use and function of the pair of legs 118 depicted in FIGS. 6-12 and described above.

Figures 13, 14, 15, 16, 17, 18, 19, 20, 21:
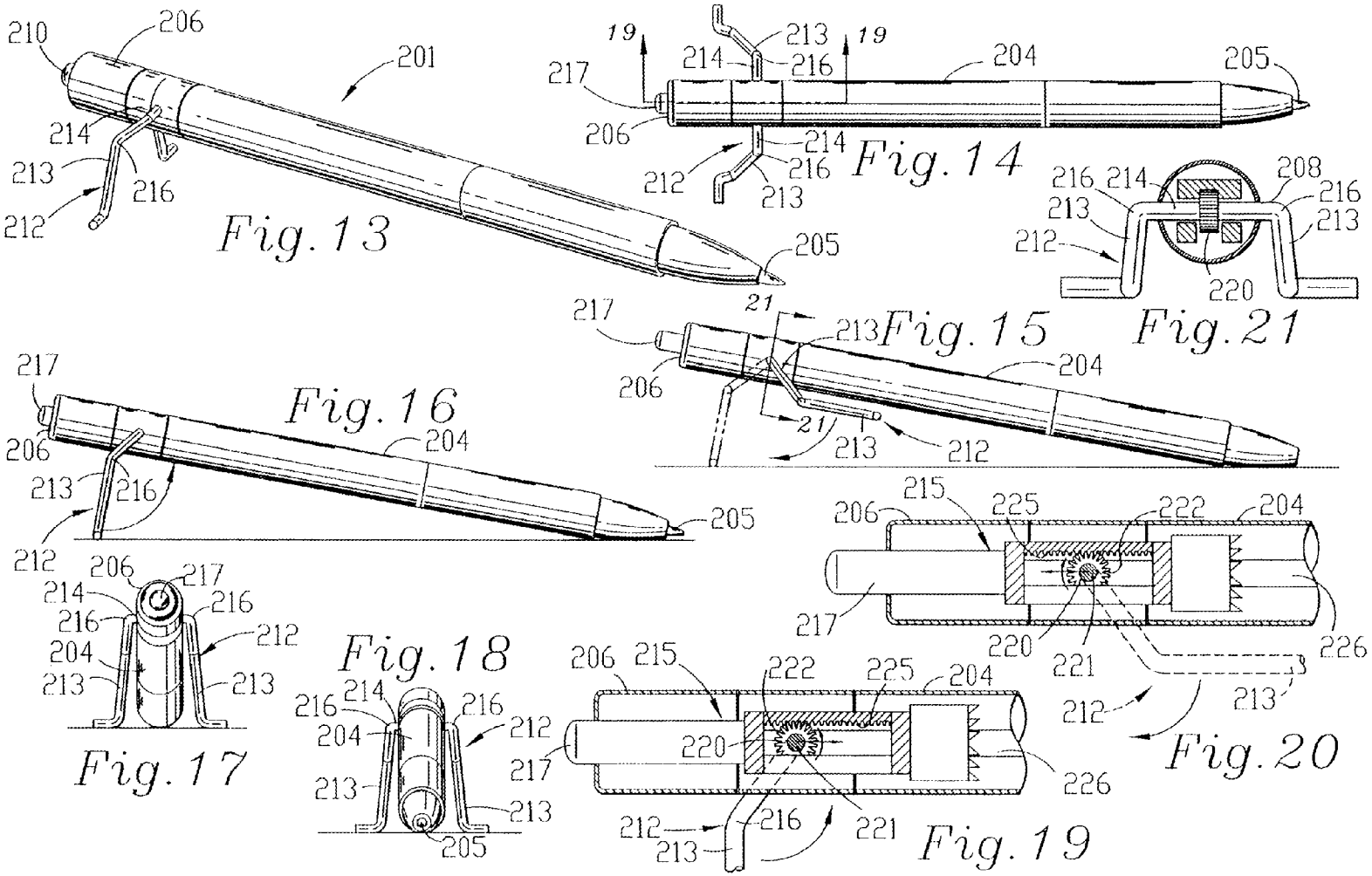
FIG. 13 is a perspective view illustrating a third embodiment of a writing instrument according to the present invention in a use configuration.
FIG. 14 is a top-plan view illustrating the third embodiment of the writing instrument in the use configuration.
FIG. 15 is a side-elevational view illustrating the third embodiment of the writing instrument in a stored configuration.
FIG. 16 is a side-elevational view illustrating the third embodiment of the writing instrument in the use configuration.
FIG. 17 is a rear-elevational view illustrating the third embodiment of the writing instrument in the use configuration.
FIG. 18 is a front-elevational view illustrating the third embodiment of the writing instrument in the use configuration.
FIG. 19 is an enlarged cross-sectional view, taken along 19-19, of FIG. 14, illustrating a rack and pinion gear system of the third embodiment of the writing instrument with the support in a use configuration.
FIG. 20 is an enlarged cross-sectional view, taken along 19-19 illustrating the rack and pinion gear system of the third embodiment of the writing instrument with the support in a stored configuration.
FIG. 21 is an enlarged cross-sectional view, taken along 21-21 of FIG. 15, illustrating a rear view of the rack and pinion gear system of the third embodiment of the writing instrument with the support in a stored configuration.

A third embodiment, depicted in FIGS. 13-21, consists of an integrated, writing instrument 201 which is a push-button actuated pen having an elongated shaft 204 and a marking or writing end 205 that is opposite a distal or rear end 206. The present embodiment has a support 212 near the distal end 206 with legs 213 and a cross bar 214 spacing and connecting the legs 213. Each of the legs 213 is bent at an elbow 216, so as to operably space the lower portion of the legs 213 near and parallel but away from the shaft 204 in a stored configuration such as is seen in solid lines in FIG. 15. The bar 214 is integrated into and operates cooperatively with a push-button mechanism 215 for the instrument 201. Specifically, the instrument 201 operates by depressing a button 217 to either extend or retract a writing or marking tip 205. The present embodiment adds a pinion gear 220 with a center axis 221 within the shaft 204 near the distal end 206, as depicted in FIGS. 19-21, that cooperatively engages the bar 214 of the support 212. The bar 214 passes through the center axis 221 of the pinion gear 220. The pinion gear 220 has a toothed outer rim 222 that engages and a rack 225 that is operably located between the push button 217 and a fluid reservoir 226. As the push button 217 is operated, the rack 225 jogs back and forth toward rear and front within the shaft 204, which causes the pinion gear 220 to spin. The pinion gear 220 causes the bar 214 to rotate, which causes the legs 213 to pivot back and forth between the stored configuration, as depicted in FIG. 15, and a use configuration, as depicted in FIG. 16.

In the use configuration, the writing instrument 201 can be placed on a horizontal surface while the distal end 206 is propped upward within easy grasp of a user and the reservoir 226, which is located within the shaft 204, as depicted in FIGS. 19 and 20, is located above the writing end 205, thus utilizing gravity to bias the fluid contents of the reservoir 226 toward the writing end 205 of the instrument 201 so that the instrument 201 is both readily graspable and immediately useable.

In the stored position, as depicted in FIG. 15, the legs 213 pivot so as to extend alongside and parallel to the shaft 204 so that the legs 213 of the support 212 may be used as a traditional pen clip for holding in a pocket or the like. Further, the legs 213 are swept backwards at an angle to provide a traditional pen clip function when the support 212 is in the stored configuration.

In either configuration, the self-supporting writing instrument 201 is designed to provide two stabilized positions at selected angular locations relative to the shaft 204.

It is to be understood that while certain forms of the present invention have been illustrated and described herein, it is not to be limited to the specific forms or arrangement of parts described and shown.

What is claimed and desired to be secured by Letters Patent is as follows:

1. A writing instrument comprising: a) a shaft having opposite ends and an elongate body with a writing tip at one of the ends of the shaft; b) said shaft containing a writing liquid reservoir communicating with said writing tip; and c) a support secured to said shaft and spaced from said writing tip whereby the support does not cover either of the ends of the shaft when the support is secured to the shaft; said support being movable with respect to the shaft from a non-extended position to an extended position in which the support projects outward away from the shaft for contact with a surface on which the instrument is placed thereby to support the shaft in a position in which a portion of the shaft is spaced away from the surface and the shaft slopes down toward the writing tip.

2. The writing instrument according to claim 1 wherein: a) said support is integral with the shaft.

3. The writing instrument according to claim 2 wherein: a) said support comprises a plurality of legs hinged to the shaft so as to be selectively foldable between a supporting use configuration when the support is in said extended position and a nonsupportive and low profile storage configuration when the support is in said non-extended position.

4. The writing instrument according to claim 3 wherein: a) said leg is bent medially therealong at an elbow such that a lower portion of said leg is spaced from and parallel to said body when said support is in the storage configuration and said leg is so aligned and configured to form a pocket clip when in the storage configuration.

5. The writing instrument according to claim 1 wherein: a) said support has at least one leg.

6. The writing instrument according to claim 1 wherein: a) said support has a plurality of legs which project outward away from the shaft when the support is in said extended position.

7. The writing instrument according to claim 6 wherein: a) said support includes a cross bar joining said legs; and (b) a keeper attached to said body for rotatably and frictionally receiving said cross bar.

8. The writing instrument according to claim 7 wherein: a) said keeper includes a flex channel to allow flexing thereof upon rotation of said bar and to initially receive said bar.

9. The writing instrument according to claim 7 wherein: a) said bar has a rectangular surface and said bar keeper has a mating interior surface.

10. The writing instrument according to claim 1 wherein: a) said instrument has a push button mechanism to activate and retract said writing tip; and b) said support being mechanically linked to said button mechanism so as to place said support in a use configuration thereof when said writing tip is activated.

11. A writing instrument comprising: a) a shaft having opposite ends and an elongate body with a writing tip at one of the ends of the shaft; b) a support secured to said shaft whereby the support does not cover either of the ends of the shaft when the support is secured to the shaft; said support being movable with respect to the shaft from a non-extended position to an extended position in which the support projects outward away from the shaft for contact with a surface on which the instrument is placed thereby to support the shaft in a position in which a portion of the shaft is spaced away from the surface and the shaft slopes down toward the writing tip.

12. The writing instrument according to claim 11 wherein: a) said support is a pencil.

13. A writing instrument comprising:

a shaft having an elongate body with a writing tip at one end of the shaft;

said shaft containing a writing liquid reservoir communicating with said writing tip; and a support secured to said shaft and spaced from said writing tip, said support projecting outwardly from said shaft so as to be adapted to space a portion of said shaft away from a surface when the instrument is placed on the surface, wherein said support has a plurality of legs, wherein said support includes a cross bar joining said legs, and a keeper attached to said body, said keeper rotatably and frictionally receiving said cross bar, wherein said keeper and said cross bar have mating non-circular cross sections and are alignable with one another so as to provide stable use and storage configurations.

* * * * *